US010183483B2

(12) United States Patent
Arakane

(10) Patent No.: US 10,183,483 B2
(45) Date of Patent: Jan. 22, 2019

(54) METHOD AND INKJET PRINTER FOR ACQUIRING GAP INFORMATION

(71) Applicant: BROTHER KOGYO KABUSHIKI KAISHA, Nagoya, Aichi (JP)

(72) Inventor: Satoru Arakane, Aichi (JP)

(73) Assignee: BROTHER KOGYO KABUSHIKI KAISHA, Nagoya, Aichi (JP)

( * ) Notice: Subject to any disclaimer, the term of this patent is extended or adjusted under 35 U.S.C. 154(b) by 0 days.

(21) Appl. No.: 15/796,935

(22) Filed: Oct. 30, 2017

(65) Prior Publication Data

US 2018/0043683 A1 Feb. 15, 2018

Related U.S. Application Data

(63) Continuation of application No. 15/131,667, filed on Apr. 18, 2016, now Pat. No. 9,821,550, which is a (Continued)

(30) Foreign Application Priority Data

Mar. 30, 2012 (JP) ..... 2012-082616

(51) Int. Cl.
*B41J 2/045* (2006.01)
*B41J 2/21* (2006.01)
(Continued)

(52) U.S. Cl.
CPC ..... *B41J 2/04508* (2013.01); *B41J 2/01* (2013.01); *B41J 2/2135* (2013.01); *B41J 11/005* (2013.01);
(Continued)

(58) Field of Classification Search
CPC .. B41J 2/04508; B41J 2/04556; B41J 2/2135; B41J 2/01; B41J 11/005; B41J 19/145; B41K 25/308
See application file for complete search history.

(56) References Cited

U.S. PATENT DOCUMENTS 5,366,301 A 11/1994 Martin et al.
5,515,094 A 5/1996 Tanaka et al.
(Continued)

FOREIGN PATENT DOCUMENTS

CN 1990242 A 7/2007
CN 101058244 A 10/2007
(Continued)

OTHER PUBLICATIONS

Notice of Allowance dated May 25, 2018 received in related U.S. Appl. No. 15/830,424.
(Continued)

*Primary Examiner* — Juanita D Jackson
(74) *Attorney, Agent, or Firm* — Scully, Scott, Murphy & Presser, P.C.

(57) ABSTRACT

A method is provided that is implemented on a control device connected with an inkjet printer, which includes an inkjet head having an ink discharging surface, a head scanning unit reciprocating the inkjet head relative to a recording sheet along a scanning direction parallel to the ink discharging surface, and a wave shape generating mechanism deforming the recording sheet in a predetermined wave shape that has tops of portions protruding in a first direction toward the ink discharging surface and bottoms of portions recessed in a second direction opposite to the first direction alternately arranged along the scanning direction, the method including acquiring gap information related to a gap between the ink discharging surface and each individual one of the tops and the bottoms on the recording sheet, and determining whether the gap information acquired for each individual one of the tops and the bottoms is abnormal.

13 Claims, 9 Drawing Sheets

Related U.S. Application Data continuation of application No. 14/535,845, filed on Nov. 7, 2014, now Pat. No. 9,315,056, which is a continuation of application No. 13/728,629, filed on Dec. 27, 2012, now Pat. No. 8,882,215.

(51) Int. Cl.

| | |
|---|---|
| ***B41J 11/00*** | (2006.01) |
| ***B41J 19/14*** | (2006.01) |
| ***B41J 2/01*** | (2006.01) |
| ***B41J 25/308*** | (2006.01) |
| *B41J 29/393* | (2006.01) |

(52) U.S. Cl.

CPC ..... *B41J 19/145* (2013.01); *B41J 25/308* (2013.01); *B41J 2029/3935* (2013.01)

(56) References Cited

U.S. PATENT DOCUMENTS

| | | | |
|---|---|---|---|
| 5,659,404 | A | 8/1997 | Matsuda |
| 5,847,719 | A | 12/1998 | Yamaguchi et al. |
| 6,092,939 | A | 7/2000 | Nishikori et al. |
| 6,310,637 | B1 | 10/2001 | Shimada et al. |
| 6,336,703 | B1 | 1/2002 | Otsuki |
| 6,604,803 | B1 | 8/2003 | Hanabusa et al. |
| 6,827,418 | B2 | 12/2004 | Otokita |
| 6,900,449 | B2 | 5/2005 | Bolash et al. |
| 6,964,476 | B2 | 11/2005 | Okamoto |
| 7,083,245 | B2 | 8/2006 | Yamamoto |
| 7,267,419 | B2 | 9/2007 | Yamasaki |
| 7,309,179 | B2 | 12/2007 | Toran et al. |
| 7,530,659 | B2 | 5/2009 | Doherty et al. |
| 8,118,382 | B2 | 2/2012 | Hampel et al. |
| 8,118,422 | B2 | 2/2012 | Hibbard et al. |
| 8,282,194 | B2 | 10/2012 | Ozawa |
| 8,556,382 | B2 | 10/2013 | Kang |
| 8,714,693 | B2 | 5/2014 | Arakane |
| 8,740,328 | B2 | 6/2014 | Terada |
| 8,882,215 | B2 | 11/2014 | Arakane |
| 8,888,227 | B2 | 11/2014 | Arakane |
| 9,156,295 | B2 | 10/2015 | Arakane |
| 9,162,441 | B1 | 10/2015 | Noda |
| 9,162,502 | B2 | 10/2015 | Terada |
| 9,481,189 | B2 | 11/2016 | Arakane |
| 9,873,272 | B2 | 1/2018 | Arakane |
| 2002/0196298 | A1 | 12/2002 | Cheng |
| 2003/0001939 | A1 | 1/2003 | Scofield et al. |
| 2004/0126164 | A1 | 7/2004 | Ohyama |
| 2004/0223017 | A1 | 11/2004 | Otsuki |
| 2005/0052487 | A1 | 3/2005 | Yamasaki |
| 2005/0168557 | A1 | 8/2005 | Ohyama |
| 2007/0040878 | A1 | 2/2007 | Ikefuji et al. |
| 2007/0229562 | A1 | 10/2007 | Doherty et al. |
| 2007/0291077 | A1* | 12/2007 | Seki ..... B41J 2/175 347/37 |
| 2008/0150978 | A1 | 6/2008 | Sato et al. |
| 2009/0085949 | A1 | 4/2009 | Sugiyama et al. |
| 2009/0122098 | A1 | 5/2009 | Shindo |
| 2009/0251521 | A1 | 10/2009 | Arai |
| 2009/0262157 | A1 | 10/2009 | Sato et al. |
| 2011/0175958 | A1 | 7/2011 | Sato et al. |
| 2011/0249049 | A1 | 10/2011 | Taira et al. |
| 2012/0063800 | A1 | 3/2012 | Rossell et al. |

FOREIGN PATENT DOCUMENTS

| | | | |
|---|---|---|---|
| EP | 0622227 | A2 | 11/1994 |
| EP | 0622227 | A3 | 8/1995 |
| EP | 1160088 | A2 | 12/2001 |
| EP | 1182041 | A1 | 2/2002 |
| EP | 1160088 | A3 | 4/2002 |
| EP | 1449663 | A1 | 8/2004 |
| JP | H08-307688 | A | 11/1996 |
| JP | H10-138463 | A | 5/1998 |
| JP | 11-138923 | A | 5/1999 |
| JP | H11-151242 | A | 6/1999 |
| JP | 2000-71532 | A | 3/2000 |
| JP | 2001-096733 | A | 4/2001 |
| JP | 2002-160357 | A | 6/2002 |
| JP | 2003-54078 | A | 2/2003 |
| JP | 2004-17586 | A | 1/2004 |
| JP | 2004-106978 | A | 4/2004 |
| JP | 3554184 | B2 | 8/2004 |
| JP | 2004-314361 | A | 11/2004 |
| JP | 2006-192636 | A | 7/2006 |
| JP | 2006-192814 | A | 7/2006 |
| JP | 2007-25492 | A | 1/2007 |
| JP | 2007-25492 | A | 2/2007 |
| JP | 2007-144666 | A1 | 6/2007 |
| JP | 2007-144718 | A | 6/2007 |
| JP | 2008-155423 | A | 7/2008 |
| JP | 2008-155424 | A | 7/2008 |
| JP | 2008-230069 | A | 10/2008 |
| JP | 2009-23121 | A | 2/2009 |
| JP | 2009-143152 | A | 7/2009 |
| JP | 2009-178986 | A | 8/2009 |
| JP | 2009-202430 | A | 9/2009 |
| JP | 2009-202430 | A | 10/2009 |
| JP | 2009-255386 | A | 11/2009 |
| JP | 2011-218625 | A | 11/2011 |

OTHER PUBLICATIONS

U.S. Appl. No. 15/131,667, filed Apr. 18, 2016, Allowed.
U.S. Appl. No. 13/728,629, filed Dec. 27, 2012, Patented.
U.S. Appl. No. 14/535,845, filed Nov. 7, 2014, Patented.
U.S. Appl. No. 15/471,850, filed Mar. 28, 2017, Reissue Pending.
U.S. Appl. No. 13/729,386, filed Dec. 28, 2012, Patented.
U.S. Appl. No. 15/243,358, filed Aug. 22, 2016, Pending.
U.S. Appl. No. 13/729,753, filed Dec. 28, 2012, Patented.
U.S. Appl. No. 14/246,238, filed Apr. 7, 2014, Patented.
U.S. Appl. No. 14/587,267, filed Dec. 31, 2014, Patented.
U.S. Appl. No. 14/886,527, filed Oct. 19, 2015, Patented.
U.S. Appl. No. 15/278,737, filed Sep. 28, 2016, Allowed.
U.S. Appl. No. 13/729,697, filed Dec. 28, 2012, Patented.
U.S. Appl. No. 14/223,334, filed Mar. 24, 2014, Patented.
U.S. Appl. No. 14/542,025, filed Nov. 14, 2014, Patented.
U.S. Appl. No. 14/879,927, filed Oct. 9, 2015, Patented.
U.S. Appl. No. 15/369,323, filed Dec. 5, 2016, Pending.
U.S. Appl. No. 13/729,192, filed Dec. 28, 2012, Patented.
Extended European Search Report dated Jul. 11, 2013 from related EP 12199734.0 from related U.S. Appl. No. 13/729,697.
Notice of Allowance dated Dec. 24, 2013 from related U.S. Appl. No. 13/729,697.
Notice of Allowance dated Jul. 18, 2014 from related U.S. Appl. No. 14/223,334.
U.S. Official Action dated Dec. 18, 2014 received in related U.S. Appl. No. 14/542,025.
Notice of Allowance dated Jun. 8, 2015 from related U.S. Appl. No. 14/542,025.
U.S. Official Action dated Mar. 24, 2016 received in related U.S. Appl. No. 14/879,927.
Notice of Allowance dated Aug. 3, 2016 from related U.S. Appl. No. 14/879,927.
Extended European Search Report dated Jul. 9, 2013 from related EP 12199740.7 from related U.S. Appl. No. 13/729,753.
Notice of Allowance dated Jan. 8, 2014 from related U.S. Appl. No. 13/729,753.
Notification of First Office Action dated Sep. 4, 2014 received from the Chinese Patent Office from related Chinese Patent Application No. 201210586540.3, together with an English language translation.
Notice of Allowance dated Sep. 2, 2014 from related U.S. Appl. No. 14/246,238.
Notice of Reasons for Rejection dated Jul. 15, 2014 from related Japanese Application No. 2012-082621, together with an English language translation.

(56) References Cited

OTHER PUBLICATIONS

Japanese Official Action dated Feb. 17, 2015 received in related application JP 2012-082621 together with an English language translation.
Notice of Allowance dated Feb. 20, 2015 from related U.S. Appl. No. 14/587,267.
Notice of Allowance dated Jun. 12, 2015 from related U.S. Appl. No. 14/587,267.
Notice of Allowance dated Jul. 23, 2015 from related U.S. Appl. No. 14/587,267.
Official Action dated Jan. 4, 2016 from related U.S. Appl. No. 14/886,527.
Notice of Allowance dated May 27, 2016 from related U.S. Appl. No. 14/886,527.
Japanese Notification of Reasons for Rejection dated Jul. 26, 2016 received in related application JP 2015-173555 together with an English language translation.
Extended European Search Report dated Jul. 9, 2013 from related EP 12199737.3.
U.S. Office Action dated Feb. 5, 2014 from related U.S. Appl. No. 13/729,386.
U.S. Office Action dated May 13, 2014 from related U.S. Appl. No. 13/729,386.
U.S. Office Action dated Apr. 15, 2015 from related U.S. Appl. No. 13/729,386.
U.S. Office Action dated Nov. 2, 2015 from related U.S. Appl. No. 13/729,386.
Notice of Allowance dated Apr. 18, 2016 from related U.S. Appl. No. 13/729,386.
Notification of Reasons for Rejection dated Sep. 20, 2016 issued in Japanese Application No. 2012-286358.
U.S. Office Action dated Feb. 14, 2017 from related U.S. Appl. No. 15/243,358.
Extended European Search Report dated Jul. 10, 2013 from related EP 12199749.8.
Notice of Allowance dated Jul. 9, 2014 issued in parent case, U.S. Appl. No. 13/728,629, filed Dec. 27, 2012.
Office Action dated Jan. 9, 2015 issued in parent case, U.S. Appl. No. 14/535,845, filed Nov. 7, 2014.
Office Action dated Jul. 9, 2015 issued in parent case, U.S. Appl. No. 14/535,845, filed Nov. 7, 2014.
Japanese Official Action dated Feb. 2, 2016 received in related application JP 2012-286356 together with an English language translation.
Japanese Official Action dated Feb. 2, 2016 received in related application JP 2012-286357 together with an English language translation.
Japanese Official Action dated Feb. 2, 2016 received in related application JP 2012-286358 together with an English language translation.
Notification of Reasons for Rejection dated Jan. 27, 2017 received in related application JP 2015-173555 together with an English language translation.
United States Official Action dated May 5, 2017 received in related U.S. Appl. No. 15/369,323.
United States Notice of Allowance dated Apr. 12, 2017 received in related U.S. Appl. No. 15/278,737.
Extended European Search Report dated Jul. 9, 2013 from related EP 12199743.1.
European Official Action dated Dec. 21, 2015 received in related application EP 12 199 743.1.
List of Patents or Patent Applications Treated as Related dated Oct. 17, 2017, 3 pages.
United States Official Action dated Mar. 30, 2018 received in related U.S. Appl. No. 15/243,358.
Official Action dated Jul. 27, 2018 from related U.S. Appl. No. 15/876,722.

* cited by examiner

METHOD AND INKJET PRINTER FOR ACQUIRING GAP INFORMATION

CROSS-REFERENCE TO RELATED APPLICATIONS

This application is a continuation application of U.S. patent application Ser. No. 15/131,667 filed on Apr. 18, 2016 which is a continuation of U.S. patent application Ser. No. 14/535,845 filed on Nov. 7, 2014, now U.S. Pat. No. 9,315,056, issued on Apr. 19, 2016, which is a continuation application of U.S. patent application Ser. No. 13/728,629 filed on Dec. 27, 2012, now U.S. Pat. No. 8,882,215, issued on Nov. 11, 2014 and claims priority under 35 U.S.C. § 119 from Japanese Patent Application No. 2012-082616 filed on Mar. 30, 2012. The entire subject matter of each of the applications is incorporated herein by reference.

BACKGROUND

Technical Field

The following description relates to one or more techniques for acquiring gap information related to a gap between an ink discharging surface of an inkjet head and a recording medium in an inkjet printer.

Related Art

As an example of inkjet printers configured to perform printing by discharging ink from nozzles onto a recording medium, an inkjet printer has been known that is configured to perform printing by discharging ink onto a recording sheet (a recording medium) from a recording head (an inkjet head) mounted on a carriage reciprocating along a predetermined scanning direction. Further, the known inkjet printer is configured to cause feed rollers or corrugated holding spur wheels to press the recording sheet against a surface of a platen that has thereon convex portions and concave portions alternately formed along the scanning direction, so as to deform the recording sheet in a predetermined wave shape. The predetermined wave shape has mountain portions protruding toward an ink discharging surface of the recording head, and valley portions recessed in a direction opposite to the direction toward the ink discharging surface, the mountain portions and the recessed portions alternately arranged along the scanning direction.

SUMMARY

In the known inkjet printer, the gap between the ink discharging surface of the recording head and the recording sheet varies depending on portions (locations) on the recording sheet deformed in the wave shape (hereinafter, which may be referred to as a "wave-shaped recording sheet"). Therefore, when the known inkjet printer performs printing by discharging ink from the recording head onto the wave-shaped recording sheet with the same ink discharging timing as when performing printing on a recording sheet not deformed in such a wave shape, an ink droplet might land in a position deviated from a desired position on the recording sheet. Thus, it might result in a low-quality printed image. Further, in this case, the positional deviation value with respect to the ink landing position on the recording sheet varies depending on the portions (locations) on the recording sheet.

In view of the above problem, for instance, the following method is considered as a measure for discharging an ink droplet in a desired position on the wave-shaped recording sheet. The method is to adjust ink discharging timing (a moment) to discharge an ink droplet from the inkjet head depending on a gap between the ink discharging surface of the inkjet head and each individual portion of the mountain portions and the valley portions formed on the recording sheet. Further, in order to adjust the ink discharging timing, it is required to acquire gap information related to the gap between the ink discharging surface of the inkjet head and each individual portion of the mountain portions and the valley portions on the recording sheet.

Meanwhile, when the known inkjet printer deforms the recording sheet in the wave shape in an undesired situation such as a high-humidity environment or a situation where the recording sheet includes a folded or curled portion, the known inkjet printer might fail to form the wave shape in a desired predetermined shape. In such an undesired situation, the mountain portions and the valley portions might be formed in shapes different from those in the desired predetermined wave shape. Further, the gap information acquired from the recording sheet deformed in the different (undesired) wave shape might provide abnormal (improper) information, which is different from normal (proper) gap information acquired from the recording sheet deformed in the desired predetermined wave shape.

Aspects of the present invention are advantageous to provide one or more improved techniques for an inkjet printer that make it possible to determine whether acquired gap information is abnormal that is related to a gap between an ink discharging surface of an inkjet head and each individual portion of mountain portions and valley portions on a recording sheet deformed in a wave shape.

According to aspects of the present invention, a method is provided that is configured to be implemented on a control device connected with an inkjet printer, the inkjet printer including an inkjet head configured to discharge ink droplets from nozzles formed in an ink discharging surface thereof, a head scanning unit configured to reciprocate the inkjet head relative to a recording sheet along a scanning direction parallel to the ink discharging surface, and a wave shape generating mechanism configured to deform the recording sheet in a predetermined wave shape that has tops of portions protruding in a first direction toward the ink discharging surface and bottoms of portions recessed in a second direction opposite to the first direction, the tops and the bottoms alternately arranged along the scanning direction, the method including steps of acquiring gap information related to a gap between the ink discharging surface and each individual one of the tops and the bottoms on the recording sheet, and determining whether the gap information acquired for each individual one of the tops and the bottoms on the recording sheet is abnormal, based on a comparison between a deviation of the gap information from a reference value and a predetermined comparison value.

According to aspects of the present invention, further provided is an inkjet printer, which includes an inkjet head configured to discharge ink droplets from nozzles formed in an ink discharging surface thereof, a head scanning unit configured to reciprocate the inkjet head relative to a recording sheet along a scanning direction parallel to the ink discharging surface, a wave shape generating mechanism configured to deform the recording sheet in a predetermined wave shape that has tops of portions protruding in a first direction toward the ink discharging surface and bottoms of portions recessed in a second direction opposite to the first direction, the tops and the bottoms alternately arranged along the scanning direction, a gap information acquiring device configured to acquire gap information related to a gap between the ink discharging surface and each individual one of the tops and the bottoms on the recording sheet, and a determining device configured to determine whether the gap information acquired for each individual one of the tops and the bottoms on the recording sheet is abnormal, based on a comparison between a deviation of the gap information from a reference value and a predetermined comparison value.

According to aspects of the present invention, further provided is an inkjet printer, which includes an inkjet head configured to discharge ink droplets from nozzles formed in an ink discharging surface thereof, a wave shape generating mechanism configured to deform a recording sheet in a predetermined wave shape that has tops of portions protruding in a first direction toward the ink discharging surface and bottoms of portions recessed in a second direction opposite to the first direction, the tops and the bottoms alternately arranged along a predetermined direction, and a control device configured to acquire gap information related to a gap between the ink discharging surface and each individual one of the tops and the bottoms on the recording sheet and determine whether the gap information acquired for each individual one of the tops and the bottoms on the recording sheet is abnormal, based on a comparison between a deviation of the gap information from a reference value and a predetermined comparison value.

BRIEF DESCRIPTION OF THE ACCOMPANYING DRAWINGS

Figure 1:
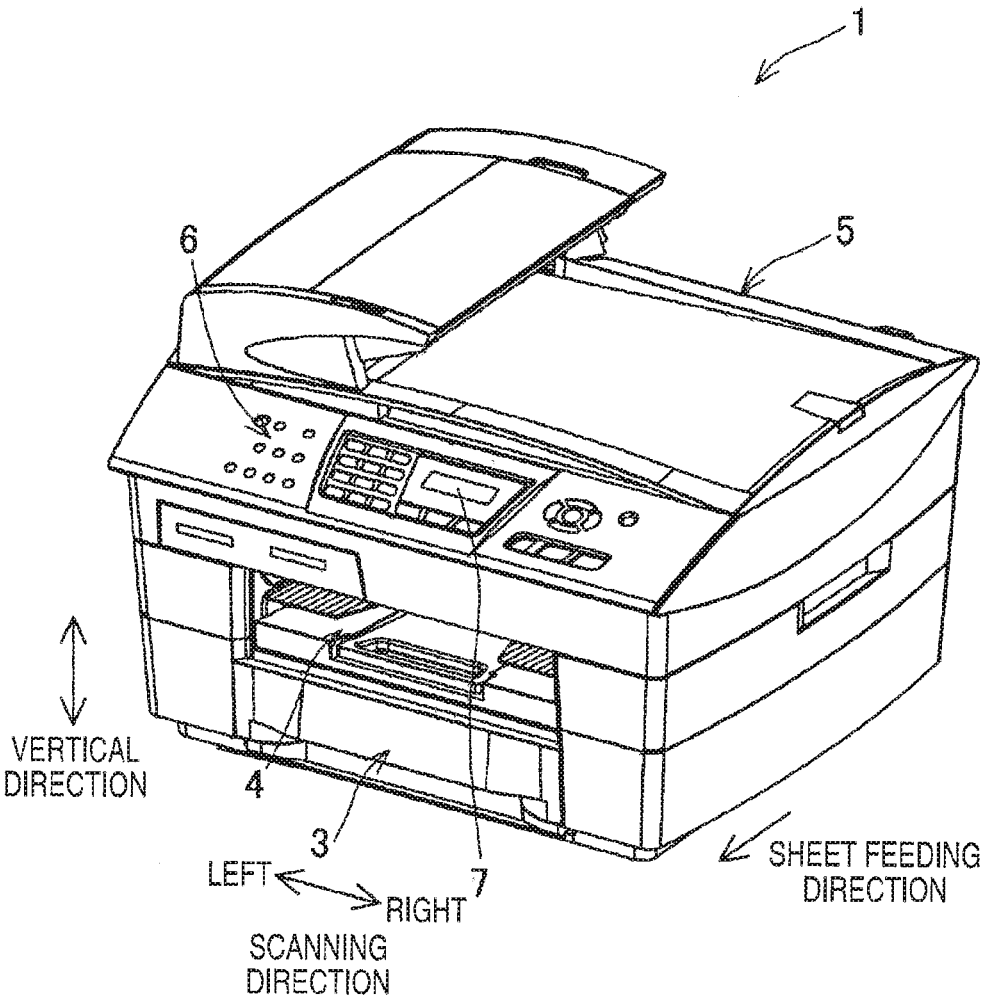
FIG. 1 is a perspective view schematically showing a configuration of an inkjet printer in an embodiment according to one or more aspects of the present invention.
Figure 2:
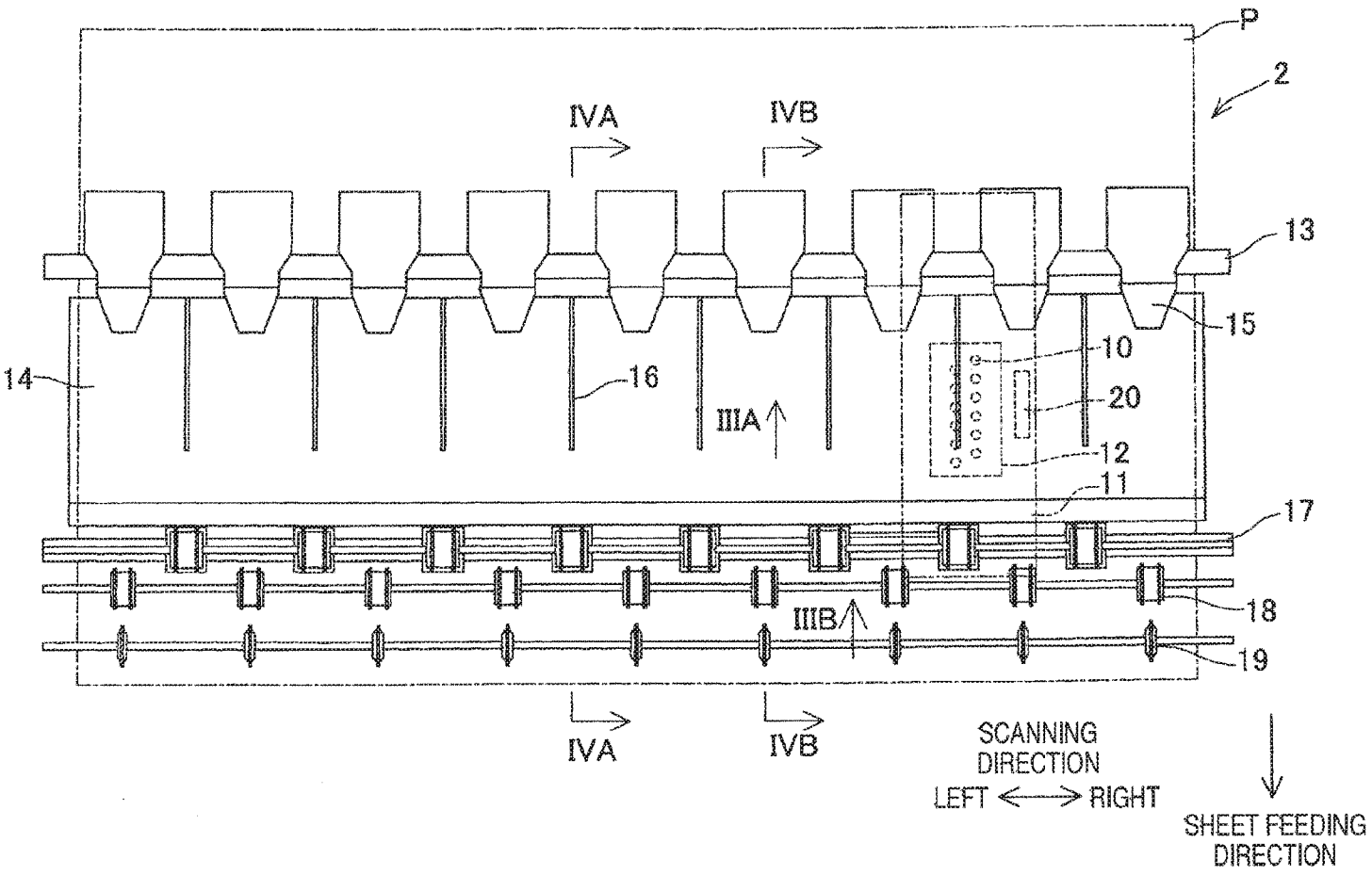
FIG. 2 is a top view of a printing unit of the inkjet printer in the embodiment according to one or more aspects of the present invention.
Figure 3A:
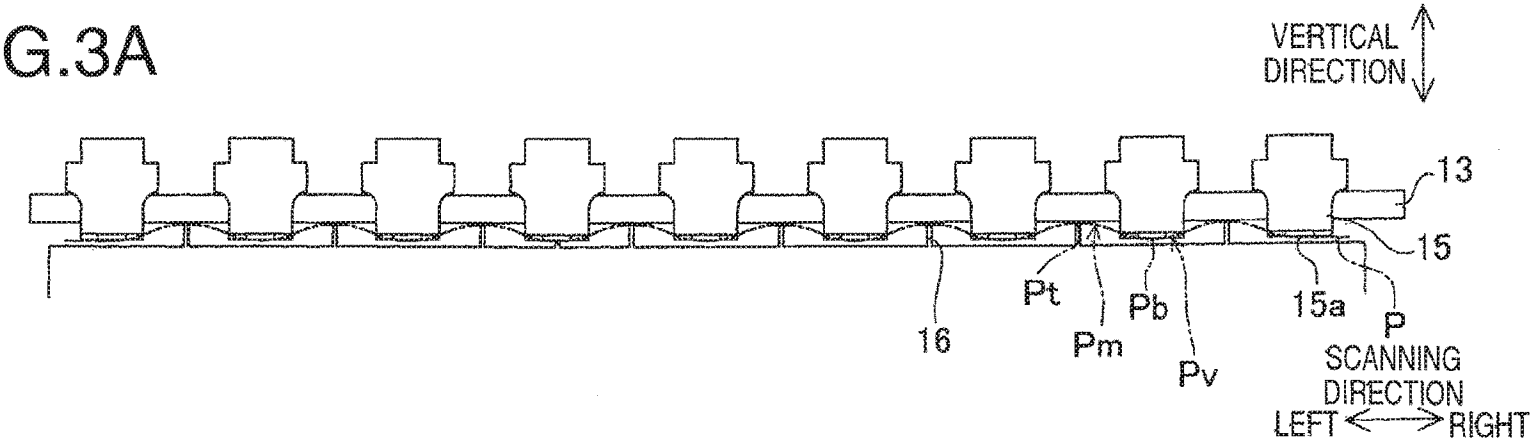

FIG. 3A schematically shows a part of the printing unit when viewed along an arrow IIIA shown in FIG. 2 in the embodiment according to one or more aspects of the present invention.

Figure 3B:
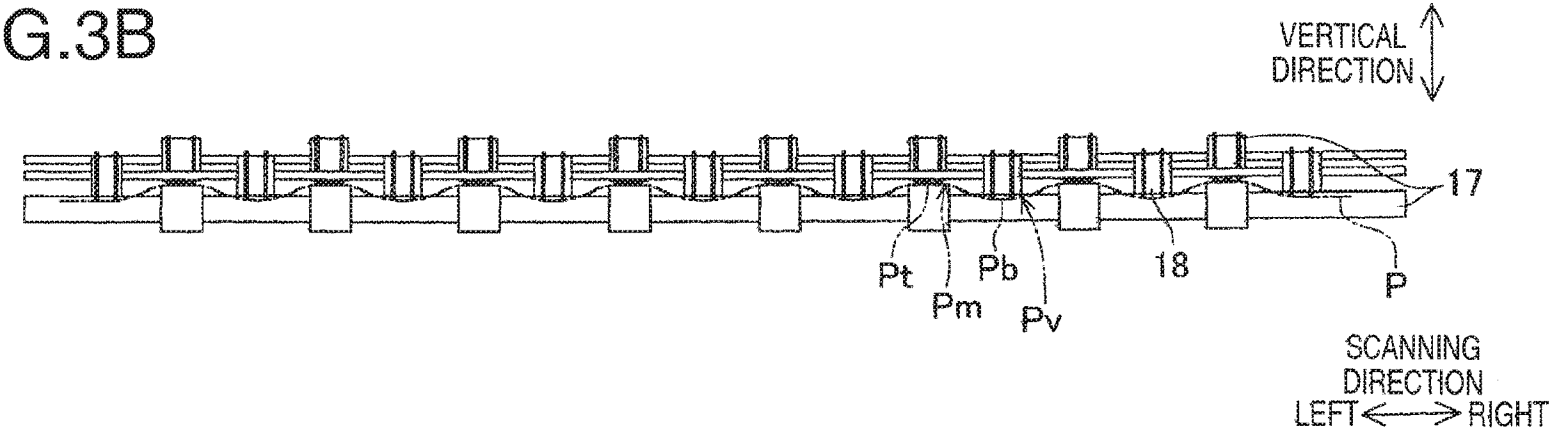

FIG. 3B schematically shows a part of the printing unit when viewed along an arrow IIIB shown in FIG. 2 in the embodiment according to one or more aspects of the present invention.

Figure 4A:
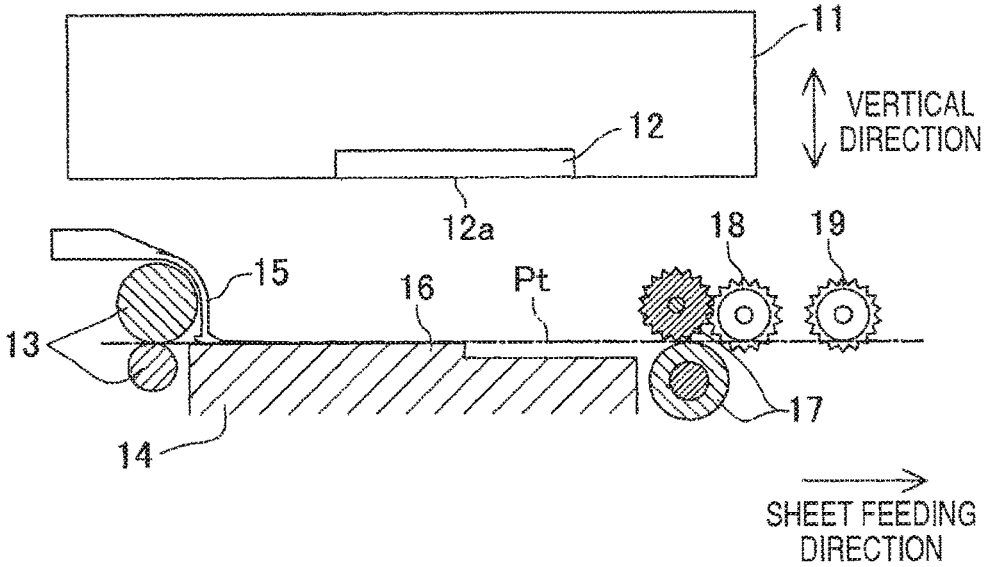

FIG. 4A is a cross-sectional view taken along a line IVA-IVA shown in FIG. 2 in the embodiment according to one or more aspects of the present invention.

Figure 4B:
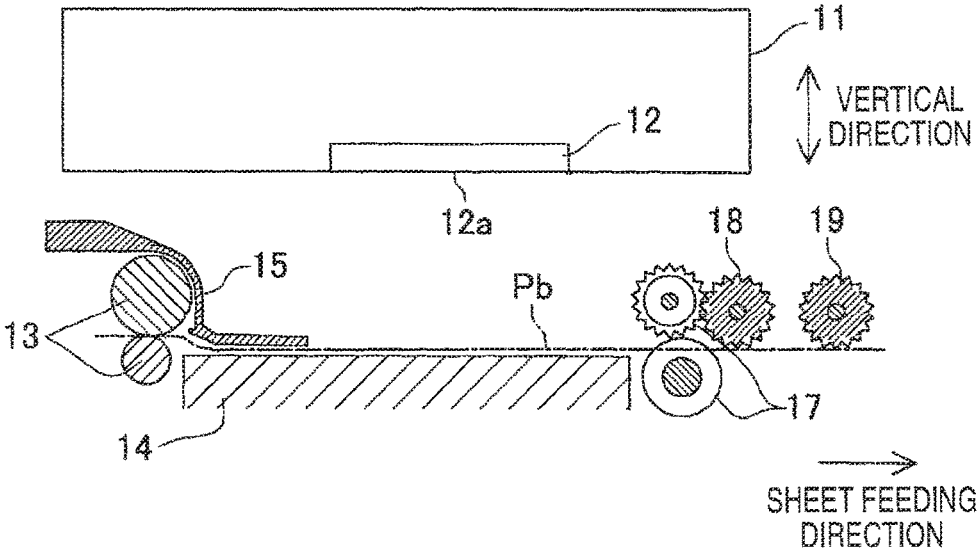

FIG. 4B is a cross-sectional view taken along a line IVB-IVB shown in FIG. 2 in the embodiment according to one or more aspects of the present invention.

Figure 5:
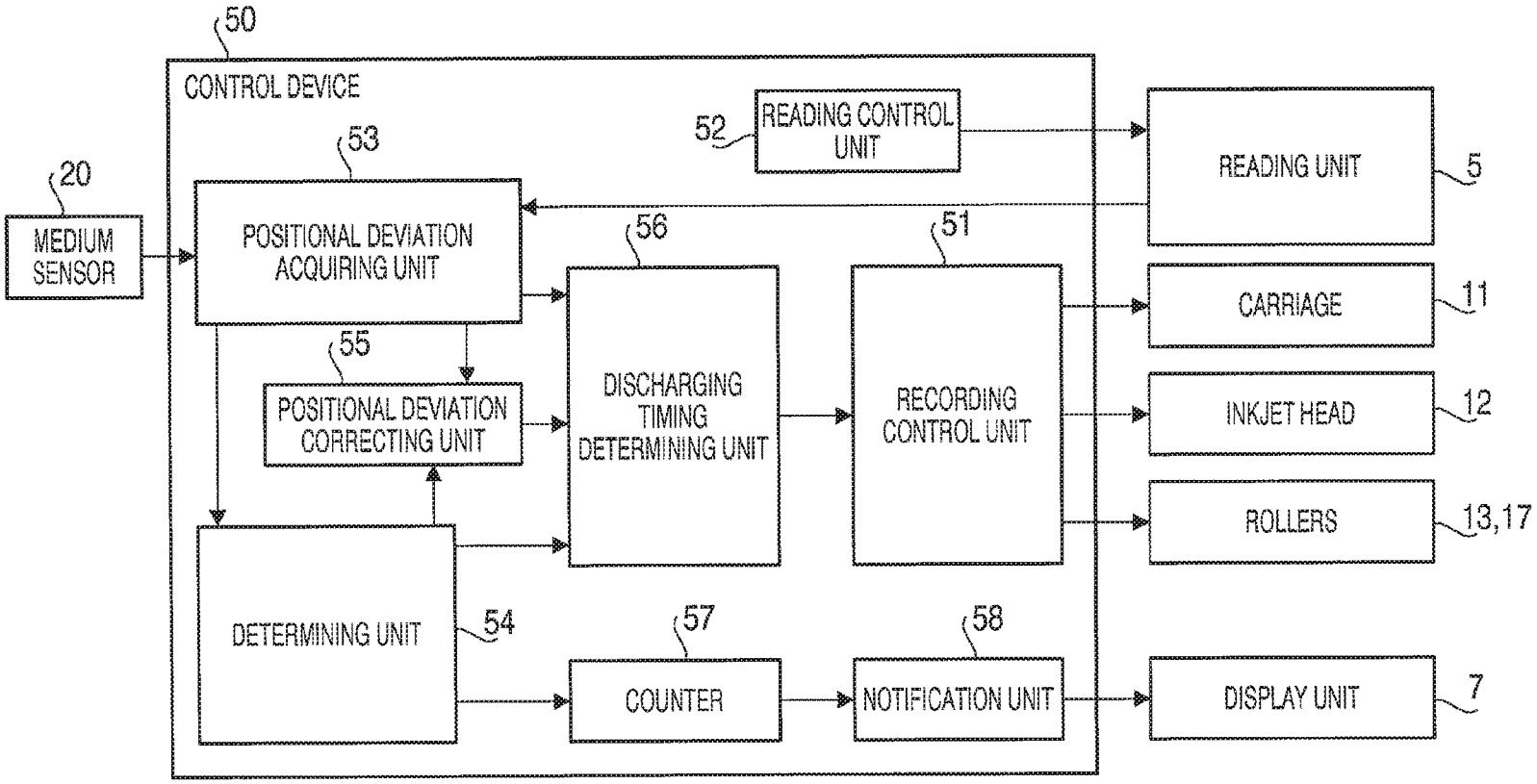

FIG. 5 is a functional block diagram of a control device of the inkjet printer in the embodiment according to one or more aspects of the present invention.

Figure 6:
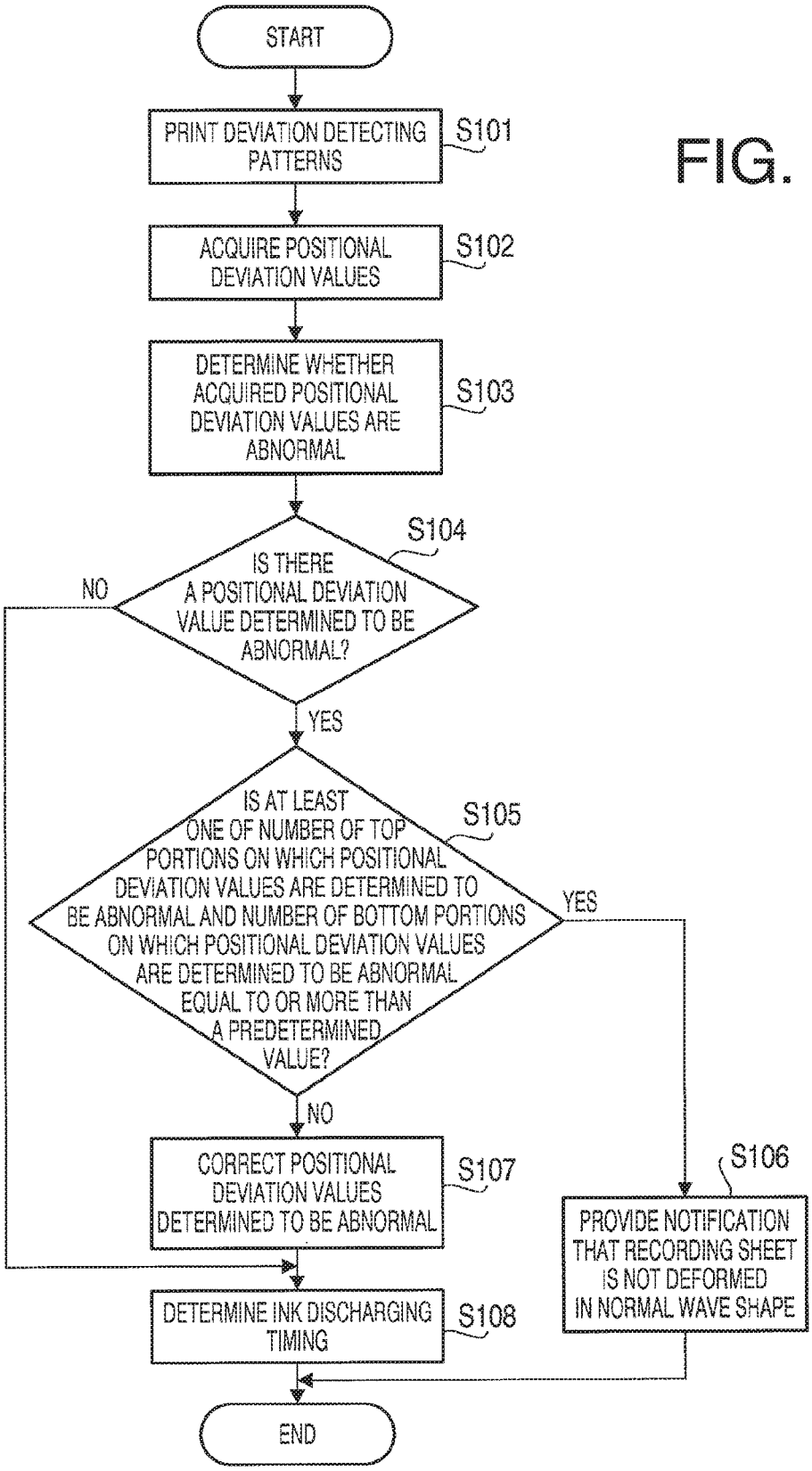

FIG. 6 is a flowchart showing a process to determine ink discharging timing to discharge ink from nozzles in the inkjet printer in the embodiment according to one or more aspects of the present invention.

Figure 7A:
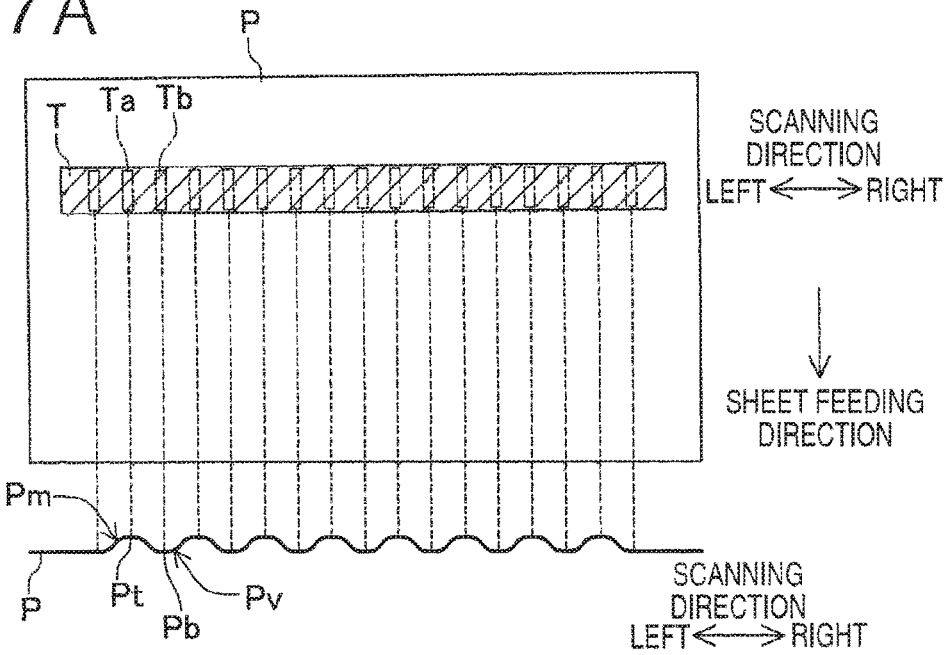

FIG. 7A shows sections to be read of a patch that includes a plurality of deviation detecting patterns printed on a recording sheet in the embodiment according to one or more aspects of the present invention.

Figure 7B:
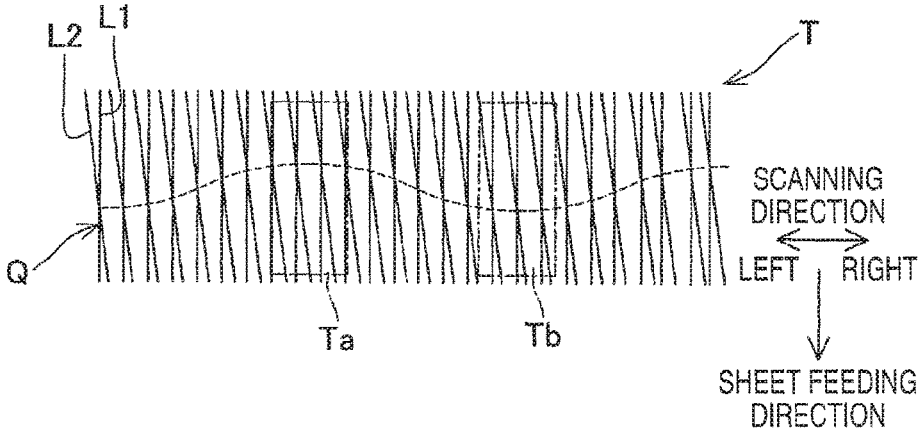

FIG. 7B is an enlarged view partially showing the patch that includes the plurality of deviation detecting patterns printed on the recording sheet in the embodiment according to one or more aspects of the present invention.

Figure 8:
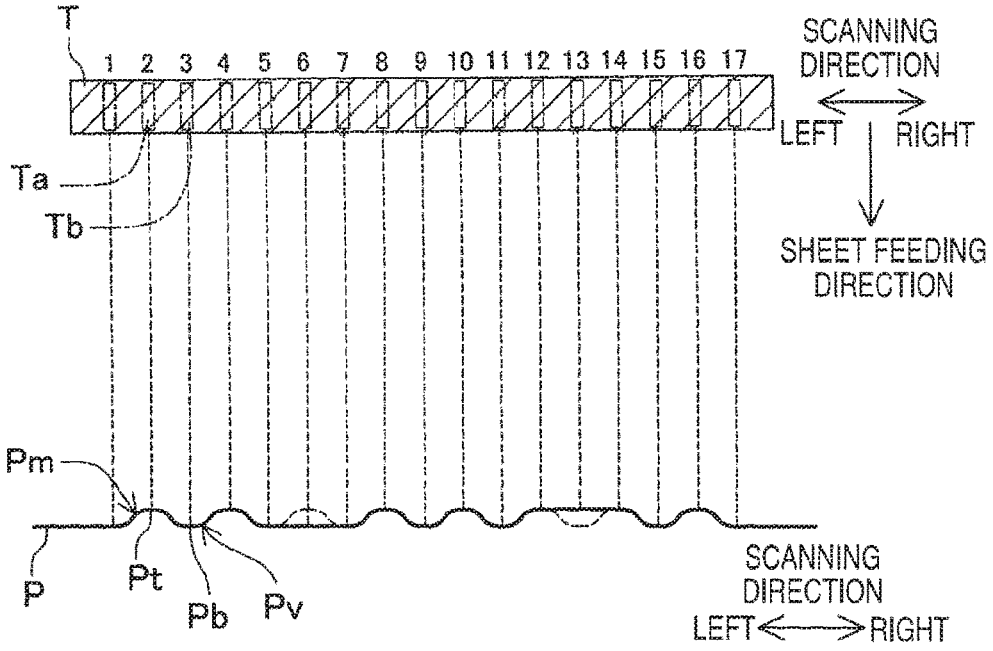

FIG. 8 shows a specific example in which it is required to replace acquired positional deviation values on a top portion and a bottom portion of the wave-shaped recording sheet in the embodiment according to one or more aspects of the present invention.

Figure 9:
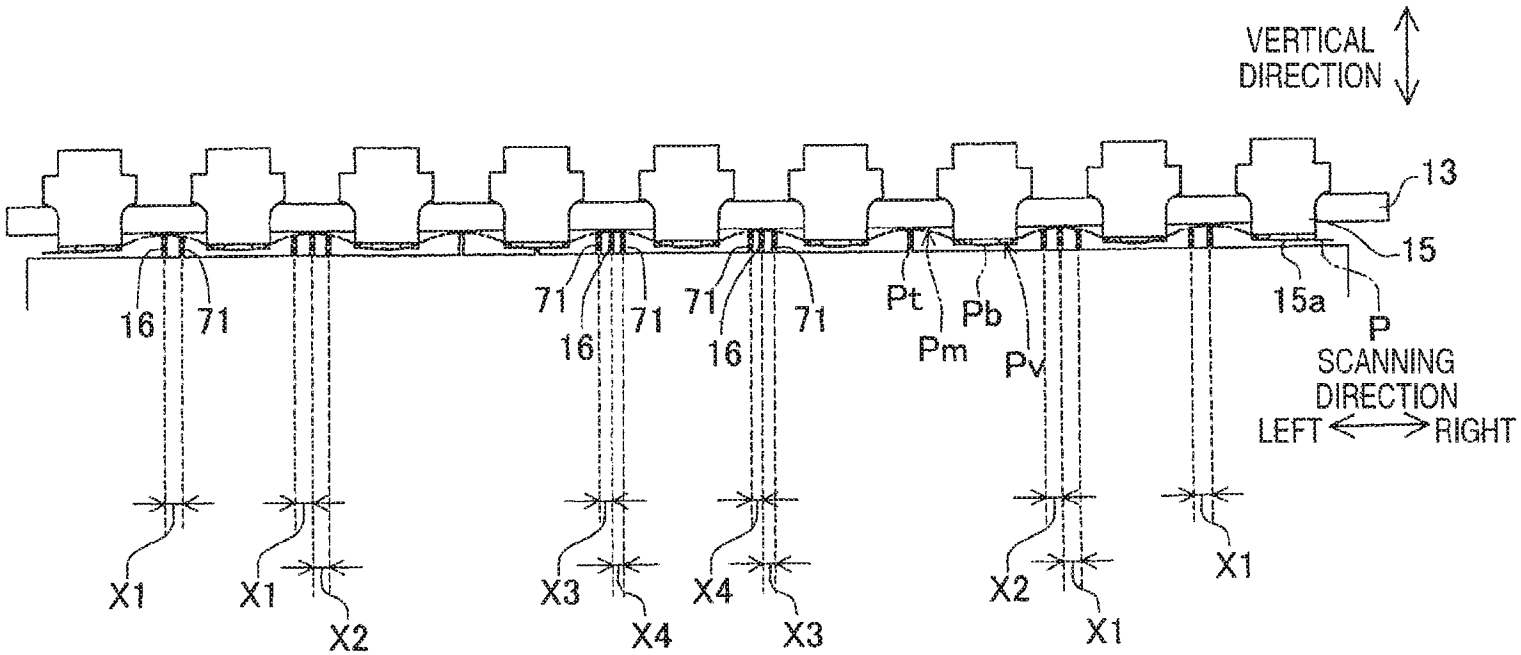

FIG. 9 schematically shows a part of the printing unit when viewed along the arrow IIIA shown in FIG. 2 in a modification according to one or more aspects of the present invention.

DETAILED DESCRIPTION

It is noted that various connections are set forth between elements in the following description. It is noted that these connections in general and, unless specified otherwise, may be direct or indirect and that this specification is not intended to be limiting in this respect. Aspects of the invention may be implemented on circuits (such as application specific integrated circuits) or in computer software as programs storable on computer readable media including but not limited to RAMs, ROMs, flash memories, EEPROMs, CD-media, DVD-media, temporary storage, hard disk drives, floppy drives, permanent storage, and the like.

Hereinafter, an embodiment according to aspects of the present invention will be described in detail with reference to the accompanying drawings.

An inkjet printer 1 of the embodiment is a multi-function peripheral having a plurality of functions such as a printing function to perform printing on a recording sheet P and an image reading function. The inkjet printer 1 includes a printing unit 2 (see FIG. 2), a sheet feeding unit 3, a sheet ejecting unit 4, a reading unit 5, an operation unit 6, and a display unit 7. Further, the inkjet printer 1 includes a control device 50 configured to control operations of the inkjet printer 1 (see FIG. 5).

The printing unit 2 is provided inside the inkjet printer 1. The printing unit 2 is configured to perform printing on the recording sheet P. A detailed configuration of the printing unit 2 will be described later. The sheet feeding unit 3 is configured to feed the recording sheet P to be printed by the printing unit 2. The sheet ejecting unit 4 is configured to eject the recording sheet P printed by the printing unit 2. The reading unit 5 is configured to be, for instance, an image scanner for reading images such as below-mentioned deviation detecting patterns Q for detecting positional deviation values of ink droplets landing on the recording sheet P. The operation unit 6 is provided with buttons. A user is allowed to operate the inkjet printer 1 via the buttons of the operation unit 6. The display unit 7 is configured, for instance, as a liquid crystal display, to display information when the inkjet printer 1 is used.

Subsequently, the printing unit 2 will be described. As shown in FIGS. 2 to 4, the printing unit 2 includes a carriage 11, an inkjet head 12, feed rollers 13, a platen 14, a plurality of corrugated plates 15, a plurality of ribs 16, ejection rollers 17, a plurality of corrugated spur wheels 18 and 19, and a medium sensor 20. It is noted that, for the sake of easy visual understanding in FIG. 2, the carriage 11 is indicated by a long dashed double-short dashed line, and portions disposed below the carriage 11 are indicated by solid lines.

The carriage 11 is configured to reciprocate along a guiderail (not shown) in a scanning direction. The inkjet head 12 is mounted on the carriage 11. The inkjet head 12 is configured to discharge ink from a plurality of nozzles 10 formed in an ink discharging surface 12*a* that is a lower surface of the inkjet head 12. It is noted that, the inkjet head 12 may be a line head extending over a whole length of a printable area in the scanning direction. In this case, a head scanning mechanism such as the carriage 11 may not be provided.

The feed rollers 13 are two rollers configured to pinch therebetween the recording sheet P fed by the sheet feeding unit 3 and feed the recording sheet P in a sheet feeding direction perpendicular to the scanning direction. The platen 14 is disposed to face the ink discharging surface 12*a*. The recording sheet P is fed by the feed rollers 13, along an upper surface of the platen 14.

The plurality of corrugated plates 15 are disposed to face an upper surface of an upstream end of the platen 14 in the sheet feeding direction. The plurality of corrugated plates 15 are arranged at substantially regular intervals along the scanning direction. The recording sheet P, fed by the feed rollers 13, passes between the platen 14 and the corrugated plates 15. At this time, pressing surfaces 15*a*, which are lower surfaces of the plurality of corrugated plates 15, press the recording sheet P from above.

Each individual rib 16 is disposed between corresponding two mutually-adjacent corrugated plates 15 in the scanning direction, on the upper surface of the platen 14. The plurality of ribs 16 are arranged at substantially regular intervals along the scanning direction. Each rib 16 protrudes from the upper surface of the platen 14 up to a level higher than the pressing surfaces 15*a* of the corrugated plates 15. Each rib 16 extends from an upstream end of the platen 14 toward a downstream side in the sheet feeding direction. Thereby, the recording sheet P on the platen 14 is supported from underneath by the plurality of ribs 16.

The ejection rollers 17 are two rollers configured to pinch therebetween portions of the recording sheet P that are located in the same positions as the plurality of ribs 16 in the scanning direction and feed the recording sheet P toward the sheet ejecting unit 4. An upper one of the ejection rollers 17 is provided with spur wheels so as to prevent the ink attached onto the recording sheet P from transferring to the upper ejection roller 17.

The plurality of corrugated spur wheels 18 are disposed substantially in the same positions as the corrugated plates 15 in the scanning direction, at a downstream side relative to the ejection rollers 17 in the sheet feeding direction. The plurality of corrugated spur wheels 19 are disposed substantially in the same positions as the corrugated plates 15 in the scanning direction, at a downstream side relative to the corrugated spur wheels 18 in the sheet feeding direction. In addition, the plurality of corrugated spur wheels 18 and 19 are placed at a level lower than a position where the ejection rollers 17 pinch the recording sheet P therebetween, in the vertical direction. The plurality of corrugated spur wheels 18 and 19 are configured to press the recording sheet P from above at the level. Further, the plurality of corrugated spur wheels 18 and 19 are not rollers having a flat outer circumferential surface but a spur wheel. Therefore, it is possible to prevent the ink attached onto the recording sheet P from transferring to the plurality of corrugated spur wheels 18 and 19.

Thus, the recording sheet P on the platen 14 is pressed from above by the plurality of corrugated plates 15 and the plurality of corrugated spur wheels 18 and 19, and is supported from underneath by the plurality of ribs 16. Thereby, as shown in FIG. 3, the recording sheet P on the platen 14 is bent and deformed in such a wave shape that mountain portions Pm protruding upward (i.e., toward the ink discharging surface 12*a*) and valley portions Pv recessed downward (i.e., in a direction opposite to the direction toward the ink discharging surface 12*a*) are alternately arranged. Further, each mountain portion Pm has a top portion Pt, protruding up to the highest position of the mountain portion Pm, which is located substantially in the same position as the center of the corresponding rib 16 in the scanning direction. Each valley portion Pv has a bottom portion Pb, recessed down to the lowest position of the valley portion Pv, which is located substantially in the same position as the corresponding corrugated plate 15 and the corresponding corrugated spur wheels 18 and 19.

The medium sensor 20 is mounted on the carriage 11 and is configured to detect whether there is a recording sheet P on the platen 14. Specifically, for instance, the medium sensor 20 includes a light emitting element and a light receiving element. The medium sensor 20 emits light from the light emitting element toward the upper surface of the platen 14. The upper surface of the platen 14 is black. Therefore, when there is not a recording sheet P on the platen 14, the light emitted from the light emitting element is not reflected by the upper surface of the platen 14 or received by the light receiving element. Meanwhile, when there is a recording sheet P on the platen 14, the light emitted from the light emitting element is reflected by the recording sheet P and received by the light receiving element. Thus, the medium sensor 20 detects whether there is a recording sheet P on the platen 14, based on whether the light receiving element receives the light emitted from the light emitting element.

The printing unit 2 configured as above performs printing on the recording sheet P by discharging ink from the inkjet head 12 reciprocating together with the carriage 11 along the scanning direction, while feeding the recording sheet P in the sheet feeding direction by the feed rollers 13 and the ejection rollers 17.

Next, an explanation will be provided about the control device 50 for controlling the operations of the inkjet printer 1. The control device 50 includes a central processing unit (CPU), a read only memory (ROM), a random access memory (RAM), and control circuits. The control device 50 is configured to function as various elements such as a recording control unit 51, a reading control unit 52, a positional deviation acquiring unit 53, a determining unit 54, a positional deviation correcting unit 55, a discharging timing determining unit 56, a counter 57, and a notification unit 58 (see FIG. 5).

The recording control unit 51 is configured to control operations of the carriage 11, the inkjet head 12, the feed rollers 13, and the ejection rollers 17 in printing by the inkjet printer 1. The reading control unit 52 is configured to control operations of the reading unit 5 to read images such as the below-mentioned deviation detecting patterns Q.

The positional deviation acquiring unit 53 acquires positional deviation values of ink droplets landing on the top portions Pt and the bottom portions Pb of the recording sheet P, from the below-mentioned deviation detecting patterns Q read by the reading unit 5. It is noted that the positional deviation values may be referred to as "gap information" related to a gap between the ink discharging surface 12*a* and each portion of the top portions Pt and the bottom portions Pb. The determining unit 54 determines whether the acquired positional deviation value is abnormal (improper) with respect to ink landing positions of ink droplets landing on each individual portion of the top portions Pt and the bottom portions Pb.

The positional deviation correcting unit 55 corrects a positional deviation value determined to be abnormal by the determining unit 54, of the positional deviation values acquired by the positional deviation acquiring unit 53. The discharging timing determining unit 56 determines ink discharging timing (moments) to discharge ink from the nozzles 10, based on the positional deviation values of ink droplets landing on the top portions Pt and the bottom portions Pb.

The counter 57 counts the number of top portions Pt and the number of bottom portions Pb on which the acquired positional deviation values are determined to be abnormal by the determining unit 54. The notification unit 58 provides a notification that the recording sheet P is not deformed in the normal wave shape, for instance, by displaying the notification on the display unit 7, when at least one of the number of the top portions Pt and the number of the bottom portions Pb counted by the counter 57 is equal to or more than a predetermined value (e.g., equal to or more than half of the total number of the top portions Pt or the bottom portions Pb).

Subsequently, an explanation will be provided about a process to determine the ink discharging timing to discharge ink from the nozzles 10 in the inkjet printer 1, with reference to FIG. 6. In order to determine the ink discharging timing to discharge ink from the nozzles 10, firstly, the control device 50 (the recording control unit 51) controls the printing unit 2 to print, on the recording sheet P, a patch T including a plurality of deviation detecting patterns Q as shown in FIGS. 7A and 7B (S101).

More specifically, for instance, the control device 50 controls the printing unit 2 to print a plurality of straight lines L1, which extend in parallel with the sheet feeding direction and are arranged along the scanning direction, by discharging ink from the nozzles 10 while moving the carriage 11 rightward along the scanning direction. After that, the control device 50 controls the printing unit 2 to print a plurality of straight lines L2, which are tilted with respect to the sheet feeding direction and intersect the plurality of straight lines L1, respectively, by discharging ink from the nozzles 10 while moving the carriage 11 leftward along the scanning direction. Thereby, as shown in FIG. 7B, the patch T is printed that includes the plurality of deviation detecting patterns Q arranged along the scanning direction, each deviation detecting pattern Q including a combination of the mutually intersecting straight lines L1 and L2. At this time, ink droplets are discharged from the nozzles 10 in accordance with design-based ink discharging timing that is determined, for example, based on an assumption that the recording sheet P is not in the wave shape but flat. Alternatively, when the positional deviation values are previously adjusted, and the ink discharging timing is previously determined in accordance with below-mentioned procedures, ink droplets may be discharged from the nozzles 10 in accordance with the previously determined ink discharging timing.

Next, the control device 50 (the reading control unit 52) controls the reading unit 5 to read the printed deviation detecting patterns Q, and the control device 50 (the positional deviation acquiring unit 53) acquires the positional deviation values of ink droplets landing on the top portions Pt and the bottom portions Pb (S102). More specifically, for example, when the deviation detecting patterns Q as shown in FIGS. 7A and 7B are printed in a situation where there is a deviation between the ink landing position in the rightward movement of the carriage 11 and the ink landing position in the leftward movement of the carriage 11, the straight line L1 and the straight line L2 of each deviation detecting pattern Q are printed to be deviated from each other in the scanning direction. Therefore, the straight line L1 and the straight line L2 intersect each other in a position deviated from the center of the straight lines L1 and L2 in the sheet feeding direction depending on the positional deviation value with respect to the ink landing positions in the scanning direction. Further, when the reading unit 5 reads each deviation detecting pattern Q, the reading unit 5 detects a higher brightness at the intersection of the straight lines L1 and L2 than the brightness at any other portion of the read deviation detecting pattern Q. Accordingly, by reading each individual deviation detecting pattern Q and acquiring a position with the highest brightness within the read deviation detecting pattern Q, it is possible to detect the position of the intersection of the straight lines L1 and L2.

In the embodiment, the control device 50 (the reading control unit 52) controls the reading unit 5 to read deviation detecting patterns Q, of the plurality of deviation detecting patterns Q, in a section Ta and a section Tb that respectively correspond to each top portion Pt and each bottom portion Pb within the patch T. Further, the control device 50 (the positional deviation acquiring unit 53) acquires the position with the highest brightness within each individual read deviation detecting pattern Q, so as to acquire the positional deviation values of ink droplets landing on the plurality of top portions Pt and the plurality of bottom portions Pb.

As described above, in S102, the control device 50 controls the reading unit 5 to read only the deviation detecting patterns Q in the sections Ta and the sections Tb. Therefore, in S101, the control device 50 may control the printing unit 2 to print at least the deviation detecting patterns Q in the sections Ta and the sections Tb.

Subsequently, the control device 50 (the determining unit 54) determines whether the acquired positional deviation value is abnormal (improper) with respect to the ink landing positions on each individual portion of the top portions Pt and the bottom portions Pb (S103). More specifically, for the top portions Pt, the control device 50 calculates the average value of the positional deviation values of ink droplets landing on the plurality of top portions Pt. Further, the control device 50 calculates the deviation of the positional deviation value on each top portion Pt relative to the calculated average value. Then, when the calculated deviation is less than a predetermined first threshold, the control device 50 determines that the positional deviation value on the top portion Pt is not abnormal. Meanwhile, when the calculated deviation is equal to or more than the first threshold, the control device 50 determines that the positional deviation value on the top portion Pt is abnormal.

A specific explanation will be provided below with reference to FIG. 8, in which reference numbers "1" to "17" are assigned to the plurality of sections Ta and Tb. The control device 50 calculates a deviation of each positional deviation value acquired from the deviation detecting patterns Q in all the sections Ta (provided with the reference numbers "2," "4," "6," "8," "10," "12," "14," and "16"), relative to the average value of the acquired positional deviation values. Then, the control device 50 determines whether or not each individual calculated deviation is equal to or more than the first threshold.

In the case of FIG. 8, the section Ta of the reference number "6" does not have a mountain portion Pt normally formed therein. Therefore, the deviation, relative to the aforementioned average value, of the positional deviation value acquired from the deviation detecting patterns Q in the section Ta of the reference number "6" is equal to or more than the first threshold. Meanwhile, the deviation, relative to the aforementioned average value, of the positional deviation value acquired from the deviation detecting patterns Q in each of the other sections Ta of the reference numbers "2," "4," "8," "10," "12," "14," and "16" is less than the first threshold.

In the same manner, for the bottom portions Pb, the control device 50 calculates the average value of the positional deviation values of ink droplets landing on the plurality of bottom portions Pb. Further, the control device 50 calculates a deviation of the positional deviation value on each bottom portion Pb relative to the calculated average value. Then, when the calculated deviation is less than a predetermined second threshold, the control device 50 determines that the positional deviation value on the bottom portion Pb is not abnormal. Meanwhile, when the calculated deviation is equal to or more than the second threshold, the control device 50 determines that the positional deviation value on the bottom portion Pb is abnormal.

Specifically, as shown in FIG. 8, the control device 50 calculates a deviation of each positional deviation value acquired from the deviation detecting patterns Q in all the sections Tb (provided with the reference numbers "1," "3," "5," "7," "9," "11," "13," "15," and "17"), relative to the average value of the acquired positional deviation values. Then, the control device 50 determines whether or not each individual calculated deviation is equal to or more than the second threshold.

In the case of FIG. 8, the section Tb of the reference number "13" does not have a bottom portion Pb normally formed therein. Therefore, the deviation, relative to the aforementioned average value, of the positional deviation value acquired from the deviation detecting patterns Q in the section Tb of the reference number "13" is equal to or more than the second threshold. Meanwhile, the deviation, relative to the aforementioned average value, of the positional deviation value acquired from the deviation detecting patterns Q in each of the other sections Tb of the reference numbers "1," "3," "5," "7," "9," "11," "15," and "17" is less than the second threshold.

When determining that there is not a top portion Pt or a bottom portion Pb on which the acquired positional deviation value is determined to be abnormal (S104: No), the control device 50 goes to a below-mentioned step S108. Meanwhile, when determining that there is a top portion Pt or a bottom portion Pb on which the acquired positional deviation value is determined to be abnormal (S104: Yes), the control device 50 (the counter 58 and the determining unit 54) determines whether at least one of the number of top portions Pt on which the acquired positional deviation values are determined to be abnormal and the number of bottom portions Pb on which the acquired positional deviation values are determined to be abnormal is equal to or more than a predetermined value (S105).

When determining that at least one of the number of top portions Pt on which the acquired positional deviation values are determined to be abnormal and the number of bottom portions Pb on which the acquired positional deviation values are determined to be abnormal is equal to or more than the predetermined value (e.g., equal to or more than half of the total number of the top portions Pt or the bottom portions Pb) (S105: Yes), the control device 50 (the notification unit 58) provides a notification that the recording sheet P is not deformed in the normal wave shape, for instance, by displaying the notification on the display unit 7 (S106). The notification provided in S106 prompts the user to reattempt at printing the deviation detecting patterns Q on another recording sheet P or to check components (such as the corrugated plates 15 and the corrugated spur wheels 18 and 19) of the inkjet printer 1. After S106, the control device 50 terminates the process shown in FIG. 6.

When determining that both the number of top portions Pt on which the acquired positional deviation values are determined to be abnormal and the number of bottom portions Pb on which the acquired positional deviation values are determined to be abnormal are less than the predetermined value (e.g., less than half of the total number of the top portions Pt or the bottom portions Pb) (S105: No), the control device 50 (the positional deviation correcting unit 55) corrects the positional deviation values determined to be abnormal (S107). Specifically, with respect to the acquired positional deviation values on the plurality of top portions Pt, the control device 50 replaces each positional deviation value determined to be abnormal with an average value of the other positional deviation values determined not to be abnormal. Further, with respect to the acquired positional deviation values on the plurality of bottom portions Pb, the control device 50 replaces each positional deviation value determined to be abnormal with an average value of the other positional deviation values determined not to be abnormal.

More specifically, as shown in FIG. 8, when there is not a top portion Pt normally formed in the section Ta of the reference number "6," the control device 50 replaces the positional deviation value acquired from each deviation detecting pattern Q in the section Ta of the reference number "6" with an average value of the positional deviation values acquired from the deviation detecting patterns Q in the other sections Ta of the reference numbers "2," "4," "8," "10," "12," "14," and "16." In the same manner, when there is not a bottom portion Pb normally formed in the section Tb of the reference number "13," the control device 50 replaces the positional deviation value acquired from each deviation detecting pattern Q in the section Tb of the reference number "13" with an average value of the positional deviation values acquired from the deviation detecting patterns Q in the other sections Tb of the reference numbers "1," "3," "5," "7," "9," "11," "15," and "17." Then, after completing the correction of the positional deviation values determined to be abnormal, the control device 50 goes to S108.

In S108, the control device 50 (the discharging timing determining unit 56) determines the ink discharging timing (moments) to discharge ink from the nozzles 10 in a printing operation. Specifically, when the positional deviation values acquired in S102 do not include an abnormal positional deviation value, the control device 50 determines the ink discharging timing based on the acquired positional deviation values. Meanwhile, when the positional deviation values acquired in S102 includes an abnormal positional deviation value, and the control device 50 corrects the abnormal positional deviation value in S107, the control device 50 determines the ink discharging timing based on the corrected positional deviation value and the normal positional deviation values.

It is noted that, in the aforementioned process, in S102, the control device 50 acquires only the positional deviation values on the top portions Pt and the bottom portions Pb. In this respect, in the embodiment, as described above, the recording sheet P is deformed in the wave shape with the top portions Pt and the bottom portions Pb alternately arranged, by the plurality of corrugated plates 15, the plurality of ribs 16, and the plurality of corrugated spur wheels 18 and 19. Therefore, by acquiring the positional deviation values on the top portions Pt and the bottom portions Pb, it is possible to estimate positional deviation values on portions of the mountain portions Pm other than the top portions Pt and on portions of the valley portions Pv other than the bottom portions Pb. Accordingly, the control device 50 determines the ink discharging timing to discharge ink onto the portions of the mountain portions Pm other than the top portions Pt and onto the portions of the valley portions Pv other than the bottom portions Pb, based on the estimated positional deviation values.

It is noted that, in S102, the control device 50 may read the deviation detecting patterns Q on the portions of the mountain portions Pm other than the top portions Pt and the portions of the valley portions Pv other than the bottom portions Pb, and may acquire positional deviation values from the read deviation detecting patterns Q. Further, the control device 50 may determine the ink discharging timing to discharge ink from the nozzles 10, based on the acquired positional deviation values. However, in this case, the number of the positional deviation values acquired by the positional deviation acquiring unit 53 is large, and it requires a large capacity of RAM for the control device 50.

According to the embodiment described above, when the recording sheet P is deformed in the wave shape with the plurality of mountain portions Pm and the plurality of valley portions Pv alternately arranged along the scanning direction, the gap between the ink discharging surface 12*a* and the recording sheet P varies depending on portions (areas) on the recording sheet P. Further, when the gap between the ink discharging surface 12*a* and the recording sheet P varies depending on portions (areas) on the recording sheet P, there are differences between the positional deviation values caused in the rightward movement of the carriage 11 and the positional deviation values caused in the leftward movement of the carriage 11. Therefore, in order to land ink droplets in appropriate positions on such a wave-shaped recording sheet P, it is required to determine the ink discharge timing to discharge the ink droplets from the nozzles 10 depending on the gap at each portion on the recording sheet P.

Thus, in the embodiment, by printing the deviation detecting patterns Q on the wave-shaped recording sheet P and reading the printed deviation detecting patterns Q, the control device 50 acquires the positional deviation values on the top portions Pt and the bottom portions Pb. Then, the control device 50 determines the ink discharging timing to discharge ink from the nozzles 10 in the printing operation, based on the acquired positional deviation values. Thereby, it is possible to land the discharged ink droplets in appropriate positions on the wave-shaped recording sheet P.

Nonetheless, at this time, when the recording sheet P on which the deviation detecting patterns Q are to be printed has a folded portion or a curled portion, the recording sheet P might not be deformed in the normal wave shape, and the deviation detecting patterns Q might not be printed in a manner complying with the normal wave shape. Therefore, in such a case, when the control device 50 reads the deviation detecting patterns Q and acquires the positional deviation values on the plurality of top portions Pt and the plurality of bottom portions Pb, the acquired positional deviation values might not be accurate.

Further, even when the deviation detecting patterns Q are normally printed on the recording sheet P without any folded portion or any curled portion, the control device 50 might not acquire the accurate positional deviation values on the top portions Pt and the bottom portions Pb due to errors in reading of the deviation detecting patterns Q by the reading unit 5.

In view of the above problems, in the embodiment, the control device 50 determines whether the acquired positional deviation values on the top portions Pt and the bottom portions Pb are abnormal, and corrects positional deviation values determined to be abnormal.

Accordingly, even when the deviation detecting patterns Q are printed on the recording sheet P that is not deformed in the normal wave shape, or there are errors caused in reading of the deviation detecting patterns Q by the reading unit 5, it is possible to determine the ink discharging timing to discharge ink from the nozzles 10, based on the accurate positional deviation values.

Further, there is not such a significant difference among the positional deviation values on the plurality of top portions Pt. Therefore, it is possible to easily determine whether the positional deviation value on each individual top portion Pt is abnormal by calculating an average value of the positional deviation values on the plurality of top portions Pt and determining whether the deviation of the positional deviation value on each individual top portion Pt relative to the calculated average value is equal to or more than the first threshold. Moreover, it is possible to accurately correct positional deviation values on top portions Pt determined to be abnormal by replacing the positional deviation values on the top portions Pt determined to be abnormal with an average value of the positional deviation values on the other top portions Pt determined not to be abnormal.

Likewise, there is not such a significant difference among the positional deviation values on the plurality of bottom portions Pb. Therefore, it is possible to easily determine whether the positional deviation value on each individual bottom portion Pt is abnormal by calculating an average value of the positional deviation values on the plurality of bottom portions Pb and determining whether the deviation of the positional deviation value on each individual bottom portion Pb relative to the calculated average value is equal to or more than the second threshold. Moreover, it is possible to accurately correct positional deviation values on bottom portions Pb determined to be abnormal by replacing the positional deviation values on the bottom portions Pb determined to be abnormal with an average value of the positional deviation values on the other bottom portions Pb determined not to be abnormal.

Thus, by replacing the positional deviation values determined to be abnormal with a representative value calculated based on the positional deviation values determined not to be abnormal, it is possible to avoid reattempting at printing of the deviation detecting patterns Q in order to acquire normal positional deviation values.

In this respect, however, when there are a lot of top portions Pt or a lot of bottom portions Pb on which the acquired positional deviation values are abnormal, it might lead to a major difference between actual positional deviation values and the average value of the acquired positional deviation values on the plurality of top portions Pt or the plurality of bottom portions Pb. Therefore, the control device 50 might not properly determine whether the acquired positional deviation values on the plurality of top portions Pt and the plurality of bottom portions Pb are abnormal. Moreover, when the control device 50 makes improper determinations as to whether the acquired positional deviation values on the plurality of top portions Pt and the plurality of bottom portions Pb are abnormal, the control device 50 does not properly determine the ink discharging timing.

In the embodiment, when at least one of the number of top portions Pt on which the acquired positional deviation values are determined to be abnormal and the number of bottom portions Pb on which the acquired positional deviation values are determined to be abnormal is equal to or more than a predetermined value, the control device 50 provides a notification that the recording sheet P is not deformed in the normal wave shape, without determining the ink discharging timing. Thereby, it is possible to prompt the user to reattempt at printing the deviation detecting patterns Q on another recording sheet P or to check components (such as the corrugated plates 15 and the corrugated spur wheels 18 and 19) of the inkjet printer 1.

Hereinabove, the embodiment according to aspects of the present invention has been described. The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without reapportioning to the details specifically set forth. In other instances, well known processing structures have not been described in detail, in order not to unnecessarily obscure the present invention.

Only an exemplary embodiment of the present invention and but a few examples of their versatility are shown and described in the present disclosure. It is to be understood that the present invention is capable of use in various other combinations and environments and is capable of changes or modifications within the scope of the inventive concept as expressed herein. For example, the following modifications are possible. It is noted that, in the following modifications, explanations about the same configurations as exemplified in the aforementioned embodiment will be omitted.

[Modifications]

In the aforementioned embodiment, in S106, the control device 50 replaces the positional deviation values on top portions Pt determined to be abnormal with the average value of the positional deviation values on the other top portions Pt determined not to be abnormal. Further, the control device 50 replaces the positional deviation values on bottom portions Pb determined to be abnormal with the average value of the positional deviation values on the other bottom portions Pb determined not to be abnormal.

However, the positional deviation values on top portions Pt determined to be abnormal may be replaced with another representative value, other than the average value, which is determined based on the positional deviation values on the other top portions Pt determined not to be abnormal. Likewise, the positional deviation values on bottom portions Pb determined to be abnormal may be replaced with another representative value, which is determined based on the positional deviation values on the other bottom portions Pb determined not to be abnormal.

For instance, a positional deviation value on a target top portion Pt determined to be abnormal may be replaced with a positional deviation value on a top portion Pt that is the closest to the target top portion Pt among the top portions Pt on which the positional deviation values are determined not to be abnormal. Further, a positional deviation value on a target bottom portion Pb determined to be abnormal may be replaced with a positional deviation value on a bottom portion Pb that is the closest to the target bottom portion Pb among the bottom portions Pb on which the positional deviation values are determined not to be abnormal.

Specifically, in the example shown in FIG. 8, the positional deviation value acquired from the deviation detecting patterns Q in the section Ta of the reference number "6" may be replaced with the positional deviation value acquired from the deviation detecting patterns Q in the section Ta of the reference number "4" or "8." Likewise, the positional deviation value acquired from the deviation detecting patterns Q in the section Tb of the reference number "13" may be replaced with the positional deviation value acquired from the deviation detecting patterns Q in the section Tb of the reference number "11" or "15."

Alternatively, when a target top portion Pt on which the positional deviation value is determined to be abnormal is between two neighboring top portions Pt, adjacent to the target top portion Pt, on which the positional deviation values are determined not to be abnormal, the positional deviation value on the target top portion Pt may be replaced with the average value of the positional deviation values on the two neighboring top portions Pt. Likewise, when a target bottom portion Pb on which the positional deviation value is determined to be abnormal is between two neighboring bottom portions Pb, adjacent to the target bottom portion Pb, on which the positional deviation values are determined not to be abnormal, the positional deviation value on the target bottom portion Pb may be replaced with the average value of the positional deviation values on the two neighboring bottom portions Pb.

Specifically, in the example shown in FIG. 8, the positional deviation value acquired from the deviation detecting patterns Q in the section Ta of the reference number "6" may be replaced with the average value of the positional deviation value acquired from the deviation detecting patterns Q in the section Ta of the reference number "4" and the positional deviation value acquired from the deviation detecting patterns Q in the section Ta of the reference number "8." Likewise, the positional deviation value acquired from the deviation detecting patterns Q in the section Tb of the reference number "13" may be replaced with the average value of the positional deviation value acquired from the deviation detecting patterns Q in the section Tb of the reference number "11" and the positional deviation value acquired from the deviation detecting patterns Q in the section Tb of the reference number "15."

Furthermore, the representative value with which the positional deviation values on top portions Pt determined to be abnormal are to be replaced is not limited to a value determined based on the positional deviation values on the other top portions Pt determined not to be abnormal. Likewise, the representative value with which the positional deviation values on bottom portions Pb determined to be abnormal are to be replaced is not limited to a value determined based on the positional deviation values on the other bottom portions Pb determined not to be abnormal. In the aforementioned embodiment, as described above, the recording sheet P is deformed in the wave shape with the top portions Pt and the bottom portions Pb alternately arranged, by the corrugated plates 15, the ribs 16, and the corrugated spur wheels 18 and 19. Therefore, it is possible to estimate how high the top portions Pt and the bottom portions Pb are.

Hence, for instance, a setting value (a first setting value) as a representative positional deviation value for the top portions Pt may previously be determined based on the estimated height of the top portions Pt. Likewise, a setting value (a second setting value) as a representative positional deviation value for the bottom portions Pb may previously be determined based on the estimated height (depth) of the bottom portions Pb. Then, in S107, the positional deviation values on top portions Pt determined to be abnormal may be replaced with the first setting value. Further, the positional deviation values on bottom portions Pb determined to be abnormal may be replaced with the second setting value.

Further, in the aforementioned embodiment, when determining that at least one of the number of top portions Pt on which the acquired positional deviation values are determined to be abnormal and the number of bottom portions Pb on which the acquired positional deviation values are determined to be abnormal is equal to or more than the predetermined value (S105: Yes), the control device 50 provides a notification that the recording sheet P is not deformed in the normal wave shape (S106), and thereafter terminates the process shown in FIG. 6.

However, for instance, regardless of the number of top portions Pt on which the acquired positional deviation values are determined to be abnormal or the number of bottom portions Pb on which the acquired positional deviation values are determined to be abnormal, the ink discharging timing to discharge ink from the nozzles 10 may be determined in the same manner as executed in S107 and S108 of the aforementioned embodiment.

Alternatively, when determining that at least one of the acquired positional deviation values on the plurality of top portions Pt and the plurality of bottom portions Pb is abnormal, the control device 50 may provide a notification that the recording sheet P is not deformed in the normal wave shape, and thereafter may terminate the process. It is noted that, in this case, the control device 50 does not correct any positional deviation value determined to be abnormal.

Further, in the aforementioned embodiment, the control device 50 calculates the average value of the positional deviation values on the plurality of top portions Pt, and determines whether the deviation of the positional deviation value on each individual top portion Pt relative to the calculated average value is equal to or more than the first threshold. Then, when determining that the deviation of the positional deviation value on a top portion Pt relative to the calculated average value is equal to or more than the first threshold, the control device 50 determines that the positional deviation value on the top portion Pt is abnormal. Further, the control device 50 calculates the average value of the positional deviation values on the plurality of bottom portions Pb, and determines whether the deviation of the positional deviation value on each individual bottom portion Pb relative to the calculated average value is equal to or more than the second threshold. Then, when determining that the deviation of the positional deviation value on a bottom portion Pb relative to the calculated average value is equal to or more than the second threshold, the control device 50 determines that the positional deviation value on the bottom portion Pb is abnormal. However, the method to determine abnormal positional deviation values is not limited to the above method.

In a modification according to aspects of the present invention, as shown in FIG. 9, auxiliary ribs 71 having the same height lower than the height of the ribs 16 are formed at the right side of the leftmost rib 16, at both the left and right sides of each of the second, fourth, fifth, and seventh ribs from the left end in the scanning direction, and at the left side of the rightmost rib 16. An auxiliary rib 71 closer to the nearest one of the corrugated plates 15 in the scanning direction is disposed across a longer distance from a corresponding adjacent rib 16 in the scanning direction. Namely, in FIG. 9, a distance X1 is longer than a distance X2, the distance X2 is longer than a distance X3, and the distance X3 is longer than a distance X4 (X1>X2>X3>X4).

In this case, in order to deform the recording sheet P in the wave shape, the recording sheet P in a state not deformed in the wave shape is required to be pulled from the both sides in the scanning direction and pressed down. At this time, it is harder to press down a portion of the recording sheet P that is closer to a central portion of the recording sheet P in the scanning direction. Therefore, without any countermeasure against the problem, the central portion of the recording sheet P might be deformed in the normal wave shape.

In the modification, as described above, an auxiliary rib 71 closer to the nearest one of the corrugated plates 15 in the scanning direction is disposed across a longer distance from a corresponding adjacent rib 16 in the scanning direction. Hence, it is harder to press down a portion of the recording sheet P that is farther from the central portion of the recording sheet P in the scanning direction. Thereby, it is possible to press down the recording sheet P with ease uniform over the entire sheet length in the scanning direction and to certainly deform the recording sheet P in the wave shape.

Then, in this case, the control device 50 determines whether the positional deviation value on each individual top portion Pt is abnormal, in the same manner as the aforementioned embodiment. After that, the control device 50 calculates the average value of the positional deviation values on top portions Pt determined not to be abnormal. The control device 50 determines whether the deviation of the positional deviation value on each individual bottom portion Pb relative to the calculated average value is equal to or more than a third threshold and equal to or less than a fourth threshold (more than the third threshold). When determining that the deviation of the positional deviation value on a bottom portion Pb relative to the calculated average value is equal to or more than the third threshold and equal to or less than the fourth threshold, the control device 50 determines that the positional deviation value on the bottom portion Pb is not abnormal. Meanwhile, when determining that the deviation of the positional deviation value on a bottom portion Pb relative to the calculated average value is less than the third threshold or more than the fourth threshold, the control device 50 determines that the positional deviation value on the bottom portion Pb is abnormal.

Specifically, in the example shown in FIG. 8, as described above, there is not a top portion Pt normally formed in the section Ta of the reference number "6." Therefore, the control device 50 calculates the average value of the positional deviation values acquired the deviation detecting patterns Q in the sections Ta of the reference numbers "2," "4," "8," "10," "12," "14," and "16." Then, the control device 50 determines whether the deviation, relative to the calculated average value, of the positional deviation value acquired from the deviation detecting patterns Q in each individual section Tb of the reference numbers "1," "3," "5," "7," "9," "11," "13," 15," and "17" is equal to or more than the third threshold and equal to or less than the fourth threshold.

In the case of FIG. 8, there is not a bottom portion Pb normally formed in the section of the reference number "13." Therefore, the deviation, relative to the calculated average value, of the positional deviation value acquired from the deviation detecting patterns Q in the section Tb of the reference number "13" is less than the third threshold or more than the fourth threshold. Meanwhile, the deviation, relative to the calculated average value, of the positional deviation value acquired from the deviation detecting patterns Q in each individual section Tb of the reference numbers "1," "3," "5," "7," "9," "11," "15," and "17" is equal to or more than the third threshold and equal to or less than the fourth threshold.

In the modification, as described above, an auxiliary rib 71 disposed at a farther outside in the scanning direction supports the recording sheet P from underneath in a position closer to the nearest one of the corrugated plates 15 in the scanning direction. Therefore, it is harder for a farther outside portion of the recording sheet P in the scanning direction to bend down. Hence, when the recording sheet P is deformed in the wave shape, the mountain portions Pm are formed with a relatively constant height regardless of their positions in the scanning direction. Meanwhile, since it is harder to form a valley portion Pv at a farther outside in the scanning direction, the valley portions Pv are more likely to be formed with different heights depending on their positions in the scanning direction, in comparison with the mountain portions Pm.

In the modification, it is possible to make an accurate determination as to whether the positional deviation value on each individual bottom portion Pb is abnormal by determining whether the deviation of the above positional deviation relative to the average value of the positional deviation values on the top portions Pt formed with a relatively constant height is equal to or more than the third threshold and equal to or less than the third threshold.

Further, in the modification, the distance between each individual one of the auxiliary ribs 71 and a corresponding one of the ribs 16 in the scanning direction is not constant. Hence, when the inkjet printer 1 is used in a high-humidity environment, the mountain portions Pm are formed with different heights on the wave-shaped recording sheet P. Further, the valley portions Pv are formed with different heights (depths) on the wave-shaped recording sheet P. Thus, as described above, it is effective to determine whether the acquired positional deviation values are abnormal and to correct as needed positional deviation values determined to be abnormal.

Alternatively, as described above, since it is possible to estimate how high the top portions Pt and the bottom portions Pb are, for instance, the control device 50 may determine estimated positional deviation values on the top portions Pt and the bottom portions Pb based on the estimated heights of the top portions Pt and the bottom portions Pb, respectively. Further, the control device 50 may determine whether the acquired positional deviation value on each individual top portion Pt (see S102) is abnormal, based on a determination as to whether the deviation of the acquired positional deviation value relative to the estimated positional deviation value on the top portions Pt is equal to or more than a predetermined value. Likewise, the control device 50 may determine whether the acquired positional deviation value on each individual bottom portion Pb (see S102) is abnormal, based on a determination as to whether the deviation of the acquired positional deviation value relative to the estimated positional deviation value on the bottom portions Pb is equal to or more than a predetermined value.

In the aforementioned embodiment, the reading unit 5 of the inkjet printer 1 reads the printed deviation detecting patterns Q so as to acquire the positional deviation values on the top portions Pt and the bottom portions Pb. Further, the positional deviation correcting unit 55 of the inkjet printer 1 corrects positional deviation values determined to be abnormal. However, the configuration for reading the printed deviation detecting patterns Q to acquire and correct as needed the positional deviation values is not limited to the above configuration.

For example, the medium sensor 20 may read the printed deviation detecting patterns Q. In this case, when light emitted by the light emitting element of the medium sensor 20 is incident onto the straight line L1 or L2 of a deviation detecting pattern Q, the light is not reflected there or received by the light receiving element. Meanwhile, when the light emitted by the light emitting element of the medium sensor 20 is incident onto a portion of the recording sheet P without any straight line L1 or L2 printed thereon, the light is reflected there and received by the light receiving element. Accordingly, it is possible to recognize the existence of the straight lines L1 and L2 based on a determination as to whether the light receiving element of the medium sensor 20 receives the light emitted by the light emitting element. Thereby, it is possible to acquire a positional deviation value from positional information on the intersection of the straight lines L1 and L2.

Alternatively, for instance, in a process for manufacturing the inkjet printer 1, a device different from the inkjet printer 1 may read the deviation detecting patterns Q printed by the inkjet printer 1 to acquire the positional deviation values, and may correct as needed positional deviation values determined to be abnormal.

In this case, for instance, the positional deviation values acquired or corrected by the device different from the inkjet printer 1 may be written into the RAM of the inkjet printer 1. Further, in this case, the inkjet printer 1 may not necessarily be a multi-function peripheral having the reading unit 5. The inkjet printer 1 may be provided with only a printing function.

In the aforementioned embodiment, the control device 50 controls the reading unit 5 to read the patch T including the plurality of deviation detecting patterns Q so as to acquire the positional deviation values. However, for instance, the positional deviation values may be acquired by the following method. The method may include printing a plurality of patches T with respective ink discharging timings gradually differing by a predetermined time amount. The method may further include making the user select one of the plurality of patches T that includes a printed deviation detecting pattern Q with the straight lines L1 and L2 intersecting each other in a position closest to the center of the straight lines L1 and L2 in the sheet feeding direction (i.e., making the user select a patch T that includes a deviation detecting pattern Q printed with the smallest positional deviation value) in comparison with the other patches T, with respect to each portion of the top portions Pt and the bottom portions Pb.

In the aforementioned embodiment, the control device 50 controls the printing unit 2 to print the deviation detecting patterns Q each of which has the straight lines L1 and L2 intersecting each other, by discharging ink from the nozzles 10 while moving the carriage 11 rightward along the scanning direction to print the straight line L1 and discharging ink from the nozzles 10 while moving the carriage 11 leftward along the scanning direction to print the straight line L2.

However, for instance, deviation detecting patterns may be printed in the following method. The method may include printing a plurality of straight lines L2 on a recording sheet P, on which a plurality of lines similar to the straight lines L1 are previously formed, by discharging ink from the nozzles 10 while moving the carriage 11 rightward or leftward along the scanning direction, so as to form deviation detecting patterns each of which has a previously formed straight line and a printed straight line L2 intersecting each other. Even in this case, by reading the formed deviation detecting patterns, it is possible to acquire a positional deviation value, relative to a reference position, of an ink droplet landing on each portion of the top portions Pt and the bottom portions Pb.

Further, the deviation detecting pattern is not limited to a pattern with two straight lines intersecting each other. The deviation detecting pattern may be another pattern configured to provide a printed result that varies depending on the positional deviation value.

In the aforementioned embodiment, by printing the deviation detecting patterns Q and reading the printed deviation detecting patterns Q, the positional deviation values on the top portions Pt and the bottom portions Pb are acquired as gap information related to a gap between the ink discharging surface 12*a* and each portion on the recording sheet P. However, different information related to the gap between the ink discharging surface 12*a* and each portion on the recording sheet P may be acquired. Further, the gap between the ink discharging surface 12*a* and each portion on the recording sheet P may be acquired by directly measuring the gap.

In the aforementioned embodiment, the ink discharging timing to discharge ink from the nozzles 10 is determined based on the positional deviation values on the top portions Pt and the bottom portions Pb. However, for instance, the ink discharging timing may be determined based on positional deviation values on portions of the mountain portions Pm other than the top portions Pt and portions of the valley portions Pv other than the bottom portions Pb.

Hereinabove, the method to correct abnormal positional deviation values and adjust the ink discharging timing has been described. Nonetheless, aspects of the present invention may be applied to the following situation. The ribs 16 are smaller than the corrugated plates 15. Therefore, when forces are applied to the ribs 16 and the corrugated plates 15 during an operation of feeding the recording sheet P, a tip of a rib 16 might be chipped. At this time, since the height of the chipped rib 16 becomes lower, a corresponding mountain portion Pm of the wave-shaped recording sheet P might not be formed in a desired shape. When the corresponding mountain portion Pm is not be formed in the desired shape, a positional deviation value on a top portion Pt corresponding to the chipped rib 16 might be abnormal. Even in such a case, as described above, it is possible to grasp on which top portion Pt the acquired positional deviation value is abnormal and to recognize that the rib 16 corresponding to the top portion Pt on which the acquired positional deviation value is abnormal is chipped.

What is claimed is:

1. An inkjet printer comprising:

an inkjet head configured to discharge ink droplets from nozzles formed in an ink discharging surface thereof;

a conveyor configured to convey a recording sheet in a conveyance direction parallel to the ink discharging surface, the recording sheet having a first surface opposed to the ink discharging surface and a second surface as a reverse side of the first surface;

a plurality of ribs disposed at regular intervals along a particular direction perpendicular to the conveyance direction, the plurality of ribs being configured to support the recording sheet and deform the recording sheet supported thereon in a shape having a plurality of portions disposed along the particular direction, the plurality of portions comprising a top and a bottom, the bottom being farther from the ink discharge surface than the top in a gap direction perpendicular to the ink discharging surface, the plurality of ribs being opposed to the second surface of the recording sheet supported thereon in the gap direction; and a controller configured to:

acquire gap information related to a gap between the ink discharging surface and each individual one of the top and the bottom on the recording sheet; and determine whether the gap information acquired for each individual one of the top and the bottom on the recording sheet is abnormal.

2. The inkjet printer according to claim 1, wherein the controller is further configured to determine whether the gap information acquired for each individual one of the top and the bottom on the recording sheet is abnormal, based on a comparison between a value obtained based on the gap information and a predetermined comparison value.

3. The inkjet printer according to claim 1, wherein the plurality of ribs are further configured to deform the recording sheet in the predetermined shape, the predetermined shape having a plurality of the tops and the bottom.

4. The inkjet printer according to claim 3, wherein the controller is further configured to replace gap information determined to be abnormal among all pieces of the gap information acquired for the plurality of tops with a value determined based on pieces of gap information determined not to be abnormal among the all pieces of the gap information acquired for the plurality of tops.

5. The inkjet printer according to claim 1, wherein the plurality of ribs are further configured to deform the recording sheet in the predetermined shape, the predetermined shape having the top and a plurality of the bottoms.

6. The inkjet printer according to claim 5, wherein the controller is further configured to replace gap information determined to be abnormal among all pieces of the gap information acquired for the plurality of bottoms with a value determined based on pieces of gap information determined not to be abnormal among the all pieces of the gap information acquired for the plurality of bottoms.

7. The inkjet printer according to claim 1, further comprising a contact member configured to contact the first surface of the recording sheet supported on the plurality of ribs.

8. The inkjet printer according to claim 7, wherein the controller is further configured to acquire the gap information for each individual one of the plurality of portions of the recording sheet, the plurality of portions comprising portions positionally corresponding to the plurality of ribs in the particular direction.

9. The inkjet printer according to claim 8, wherein the contact member comprises a plurality of contact sections, each contact section being positioned between adjacent two of the plurality of ribs in the particular direction.

10. The inkjet printer according to claim 9, wherein the controller is further configured to acquire the gap information for each individual one of the plurality of portions of the recording sheet, the plurality of portions comprising portions positionally corresponding to the plurality of contact sections in the particular direction.

11. The inkjet printer according to claim 9, further comprising a sheet feeder configured to feed the recording sheet in the conveyance direction, wherein the plurality of contact sections are disposed upstream of the ink jet head in the conveyance direction.

12. A method implementable on a controller coupled with an inkjet printer comprising:

an inkjet head configured to discharge ink droplets from nozzles formed in an ink discharging surface thereof;

a conveyor configured to convey a recording sheet in a conveyance direction parallel to the ink discharging surface; and a plurality of ribs disposed at regular intervals along a particular direction perpendicular to the conveyance direction, the plurality of ribs being configured to support the recording sheet and deform the recording sheet supported thereon in a shape having a top and a bottom disposed along the particular direction, the bottom being farther from the ink discharge surface than the top in a gap direction perpendicular to the ink discharging surface, the method comprising:

acquiring gap information related to a gap between the ink discharging surface and each individual one of the top and the bottom on the recording sheet; and determining whether the gap information acquired for each individual one of the top and the bottom on the recording sheet is abnormal.

13. The method according to claim 12, wherein it is determined whether the gap information acquired for each individual one of the top and the bottom on the recording sheet is abnormal, based on a comparison between a value obtained based on the gap information and a predetermined comparison value.

* * * * *